US007621528B2

(12) United States Patent
Hara

(10) Patent No.: US 7,621,528 B2
(45) Date of Patent: Nov. 24, 2009

(54) SHEET CONVEYOR, IMAGE FORMING APPARATUS HAVING SHEET CONVEYOR, AND SHEET CONVEYING METHOD

(75) Inventor: Kazuhiro Hara, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 240 days.

(21) Appl. No.: 11/669,729

(22) Filed: Jan. 31, 2007

(65) Prior Publication Data

US 2007/0228647 A1 Oct. 4, 2007

(30) Foreign Application Priority Data

Mar. 30, 2006 (JP) ..... 2006-095763

(51) Int. Cl.
*B65H 5/02* (2006.01)

(52) U.S. Cl. ..... 271/274; 271/273

(58) Field of Classification Search ..... 271/273, 271/274

See application file for complete search history.

(56) References Cited

U.S. PATENT DOCUMENTS 4,848,765 A * 7/1989 Torii ..... 271/274
4,986,527 A * 1/1991 Ogoda ..... 271/250
6,817,611 B2 * 11/2004 DiRamio ..... 271/273

FOREIGN PATENT DOCUMENTS

JP 2000-095394 4/2000

* cited by examiner

*Primary Examiner*—David H Bollinger
(74) *Attorney, Agent, or Firm*—Turocy & Watson, LLP

(57) ABSTRACT

A sheet conveyor includes a first roller and a second roller pressurized to the first roller to hold and convey a sheet, wherein when the sheet is held between the first roller and the second roller, the first roller and second roller are separated at a space equivalent to a thickness of the sheet. The sheet conveyor has a pressurizing delay mechanism configured to bring controllably the first roller and the second roller into contact with each other after the sheet is conveyed from the first roller and the second roller.

20 Claims, 6 Drawing Sheets

Df > De

SHEET CONVEYOR, IMAGE FORMING APPARATUS HAVING SHEET CONVEYOR, AND SHEET CONVEYING METHOD

CROSS-REFERENCE TO RELATED APPLICATION

This application is based upon and claims the benefit of priority from the prior Japanese Patent Application No. 2006-95763 filed on Mar. 30, 2006, the entire contents of which are incorporated herein by reference.

BACKGROUND

1. Field of the Invention

The present invention relates to an image forming apparatus and a sheet conveyor and more particularly to a sheet conveyor, when transferring a developer image onto a sheet, regardless of a thickness of the sheet, for preventing a displacement of the developer image, an image forming apparatus having the sheet conveyor, and a sheet conveying method.

2. Description of the Related Art

In an image forming apparatus such as a color copy machine or a printer, an image forming apparatus of a type of arranging a plurality of image forming units along a photoconductor in a belt shape or sheet shape, superimposing developer images formed by the respective image forming units on the photoconductor in the belt shape or sheet shape, transferring them onto a sheet in a batch, thereby obtaining a color image is known.

In an image forming apparatus for transferring developer images onto a sheet, thereby obtaining image output, a method for stopping once the sheet guided toward the image transfer position before the image transfer position and aligning the sheet position to the developer image position is used widely. Further, it is known that an error in the stop position when the sheet is stopped once before the image transfer position causes a displacement of the developer image (from the sheet) transferred to the sheet, that is, a variation in the size of the marginal portion.

Therefore, as disclosed in Japanese Patent Application Publication No. 2000-95394, it is proposed to install a brake clutch in at least one of a pair of rollers called an aligning roller pair for temporarily stopping a sheet and prevent a shock at start time of rotation of the aligning roller pair.

On the other hand, it is known that when a sheet is thicker than a fixed thickness and the rear end of the sheet is separated from the rollers of the aligning roller pair (gets out of the position pressurized between the rollers), the respective rollers are applied with force by which the rollers intend to closely contact to each other by the pressure applied to the rollers, thereby are pressed out (the speed for conveying the sheet is increased temporarily). This varies the speed of the sheet being conveyed at the image transfer position, thus the transferred developer image is displaced.

Further, by the art disclosed in Japanese Patent Application Publication No. 2000-95394 aforementioned, the aforementioned temporary increase in the conveying speed caused when the sheet is thicker than the fixed thickness and the displacement of the transferred developer image due to a change in the speed of the sheet conveyed at the image transfer position are not canceled.

SUMMARY

An object of the present invention is to provide an image forming apparatus and a sheet conveyor, when transferring a toner image onto a sheet, even if the sheet is thicker than a fixed thickness, for preventing a displacement of the toner image.

According to the embodiments of the present invention, there is provided a sheet conveyor comprising a first roller; a second roller pressurized to the first roller to hold and convey a sheet, wherein the first roller and the second roller are separated at a space equivalent to a thickness of the sheet when the sheet is held between the first roller and the second roller; and a pressurizing delay mechanism configured to bring controllably the first roller and the second roller into contact with each other after the sheet is conveyed from the first roller and the second roller.

According to the embodiments of the present invention, there is provided an image forming apparatus comprising a transfer unit configured to transfer a toner image onto a sheet; and a sheet conveyor configured to send the sheet toward the transfer unit at predetermined timing, wherein the sheet conveyor includes a first roller; a second roller pressurized to the first roller to hold and convey the sheet, wherein the first roller and the second roller are separated at a space equivalent to a thickness of the sheet when the sheet is held between the first roller and the second roller; and a pressurizing delay mechanism configured to bring controllably the first roller and second roller into contact with each other after the sheet is conveyed from the first roller and second roller.

According to the embodiments of the present invention, there is provided a sheet conveying method comprising separating, when a sheet is held between a first roller and a second roller pressurized to the first roller to hold and convey the sheet, the first roller and the second roller at a space equivalent to a thickness of the sheet; and bringing controllably the first roller and second roller into contact with each other after the sheet is conveyed from the first roller and second roller.

DETAILED DESCRIPTION OF THE EMBODIMENTS

Figure 1:
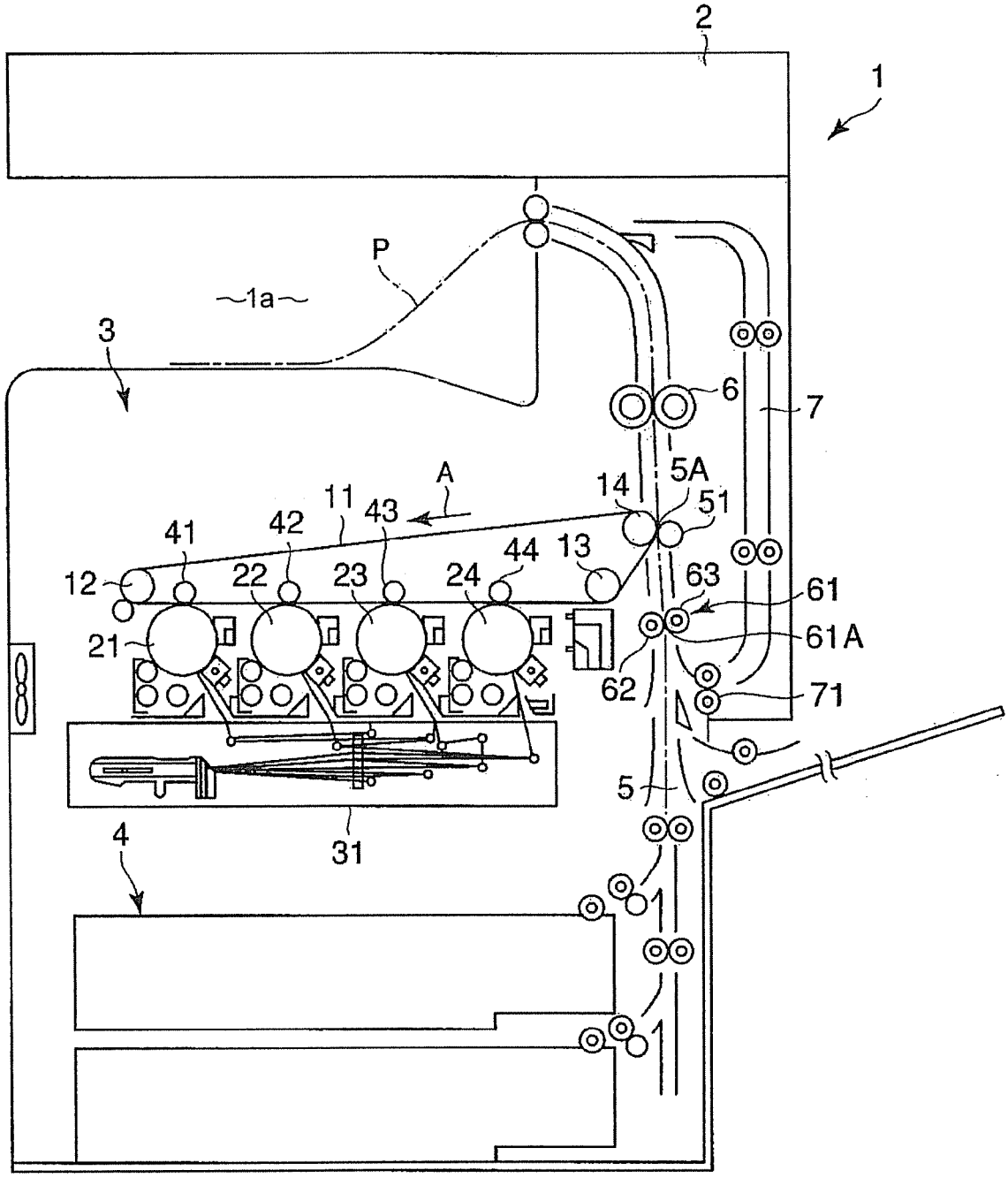
FIG. 1 is a schematic view showing an example of the image forming apparatus to which an embodiment of the present invention is applied.

Hereinafter, the embodiments of the present invention will be explained with reference to the accompanying drawings.

Further, to the same parts in the drawings, the same numerals are assigned and duplicate explanation will be omitted.

FIG. 1 schematically shows an example of the image forming apparatus to which an embodiment of the present invention is applied.

As shown in FIG. 1, the image forming apparatus, that is, a color copy machine 1 includes a scanner unit 2 and an image forming unit 3. The scanner unit 2 grasps image information of a copying object as light and shade and forms an image signal on the basis of the light and shade. The image forming unit 3, on the basis of the image signal, forms a developer image (hereinafter, referred to as a toner image) on a sheet P as an output image.

Under the image forming unit 3, the image forming apparatus has sheet cassettes 4 for taking out sheets P one by one. In correspondence to the timing of forming an output image, the sheets P are supplied one by one from the sheet cassettes 4 to the image forming unit 3.

Between the sheet cassettes 4 and the image forming unit 3, a conveying path 5 for guiding the sheets P from the sheet cassettes 4 to the image forming unit 3 is provided. The conveying path 5, via an image transfer position 6A where a toner image formed by the image forming unit 3 is transferred on the sheet P, guides the sheet P to a fixing device 6 for fixing the toner image transferred to the sheet P on the sheet P. The sheet P on which the toner image is fixed, is discharged on a sheet discharge unit 1*a* from the conveying path 5.

The image forming unit 3 has, for example, an intermediate transfer belt 11 of an insulating film formed in a belt shape. The intermediate transfer belt 11 can use a sheet-shaped thin metal whose surface is protected by resin.

The intermediate transfer belt 11 is given a predetermined tension by a driving roller 12, a first tension roller 13, and a second tension roller 14. The intermediate transfer belt 11 is moved in the direction of an arrow A by rotation of the driving roller 12. The surface of the intermediate transfer belt 11 is circulated in one direction at the moving speed of the outer peripheral surface of the driving roller 12.

In the section where the surface of the intermediate transfer belt 11 moves substantially in a plane shape, first to fourth image forming units 21, 22, 23 and 24 are arranged at predetermined spaces. Further, in the example shown in FIG. 1, in the section where the intermediate transfer belt 11 moves substantially in the plane shape between the driving roller 12 and the first tension roller 13, the first image forming unit 21 is positioned on the side of the driving roller 12 and the fourth image forming unit 24 is positioned on the side of the first tension roller 13.

The first to fourth image forming units 21 to 24 respectively include at least the developing devices for storing toners of colors of C (cyan), M (magenta), Y (yellow) and BK (black) and photoconductors for holding electrostatic images to be developed by the respective developing devices. On the photoconductors of the respective image forming units, electrostatic images of the colors to be developed by the developing devices in the image forming units are formed by image light from an exposure unit 31 and then toner images are formed by the corresponding developing devices.

Transferring rollers 41 to 44 for transferring the toner images formed on the respective photoconductors of the image forming units 21 to 24 to the intermediate transfer belt 11 are arranged on the rear side of the intermediate transfer belt 11. In the respective image forming units 21 to 24, so that the toner images transferred sequentially are mutually superimposed on the intermediate transfer belt 11, electrostatic images are formed on the intermediate transfer belt at predetermined timing and are developed by the developing devices.

By the intermediate transfer belt 11 and a transfer roller 51 pressurized to the intermediate transfer belt 11, the image transfer position 5A is formed on the conveying path 5. The toner images superimposed on the intermediate transfer belt 11 are guided by the image transfer position 5A and are transferred onto the sheet P. The transferring roller 51, when no toner images are transferred onto the sheet P, by a roller retreating mechanism not drawn, is retreated to a position far from the intermediate transfer belt 11.

At a predetermined position on the conveying path 5 between the sheet cassette 4 and the image transfer position 5A, an aligning roller pair 61 is installed. The aligning roller pair 61 temporarily stops the sheet P guided from the sheet cassette 4 to the image transfer position 5A. With respect to the aligning roller pair 61, one side of the roller is rotated in a predetermined direction and the other of the roller is pressed to one side of the roller at a predetermined pressure via a pressurizing mechanism not drawn.

The sheet P conveyed from the sheet cassette 4 to the image transfer position 5A is stopped once by the aligning roller pair 61, thus an inclination (in the conveying direction) which may be caused during conveying on the conveying path 5 from the sheet cassette 4 is corrected.

In correspondence to the timing of rerotation of the aligning roller pair 61, the timing of approaching of the toner image conveyed toward the image transfer position 5A by the intermediate transfer belt 11 to the image transfer position 5A and the timing of arrival of the sheet P at the image transfer position 5A are set. By this setting, the position of the toner image to the sheet P is set (the position of the toner image on the sheet P can be set optionally).

When the sheets P are thicker than the predetermined thickness, the moment the rear ends of the sheets P conveyed toward the fixing device 6, while the toner image is transferred at the image transfer position 5A, come out of the rollers of the aligning roller pair 61, macroscopically, the thick portion of the rear ends of the sheets P is given pressure from the rollers intending to closely contact to each other.

At this time, the conveying speed of the sheets P is increased temporarily, and although the toner image is transferred at the image transfer position 5A, the sheets P are pressed out rapidly toward the fixing device 6. This causes a displacement, that is, a transfer variation in the toner image transferred onto the sheets P at the image transfer position 5A. Further, when the image output is continued two times or more, at time of an occurrence of a transfer variation, the intermediate transfer belt, photosensitive drum, and laser scanner unit also vibrate and a primary transfer vibration and an exposure displacement may be also caused. Further, a mechanism of reducing the pressure between the rollers of the aligning roller pair before complete separation of the rear ends of the sheets P from the rollers (after the sheets P pass between the rollers, the rollers are prevented from closely contacting to each other for a predetermined period of time) is installed, thus the aforementioned phenomenon of a temporary increase in the conveying speed of the sheets P can be prevented. However, the mechanism of maintaining the distance between the rollers for the predetermined period of time until the next sheet P is guided in order to reduce the pressure between the rollers is complicated.

Figure 2A:
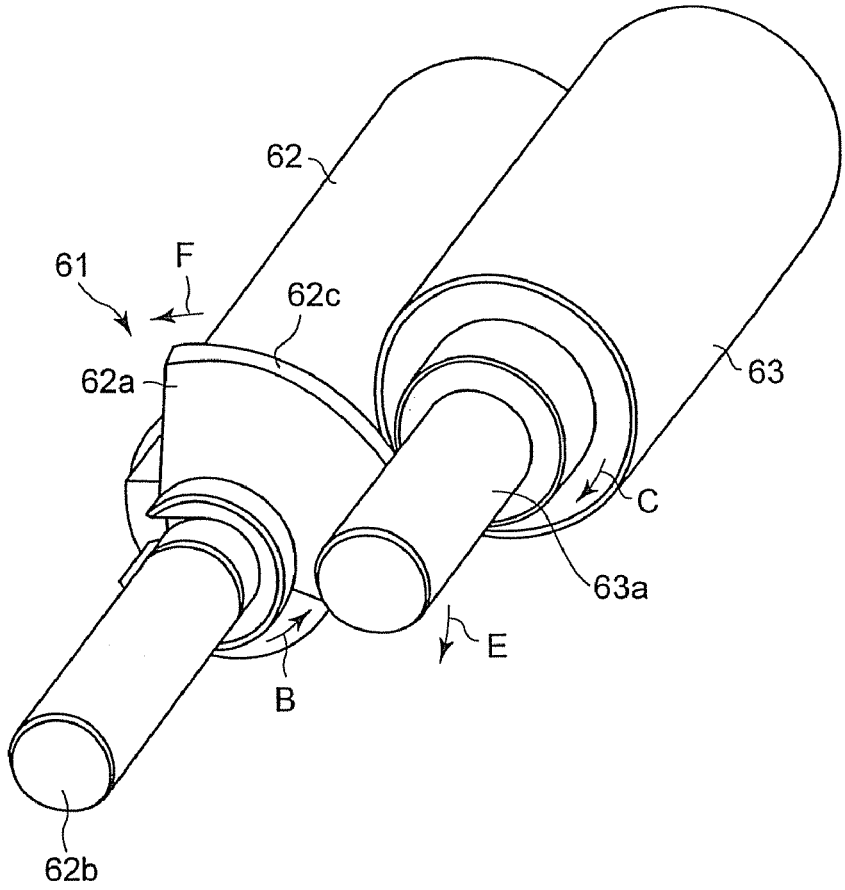
FIG. 2A is a perspective view showing the constitution of the aligning roller pair (aligning roller pressurizing delay mechanism) incorporated in the color copy machine shown in FIG. 1.

FIG. 2A shows the constitution of the aligning roller pair used in the color copy machine shown in FIG. 1.

As shown in FIG. 2A, the aligning roller pair 61 are composed of a first roller 62 and a second roller 63 which are closely contacted to each other by a predetermined pressure. Further, in the example shown in FIG. 2, the first roller 62 is rotated in the direction of an arrow B and the second roller 63 is rotated in the direction of an arrow C in the opposite direction of the arrow B. Therefore, the moving directions of the roller surfaces of the respective rollers are the same direction at a position 61A (shown in FIG. 3A) where both rollers make contact with each other.

At a predetermined position of a rotary shaft 62*b* of the first roller 62, a space setting cam 62*a* which is a pressurizing delay mechanism is provided slidably. The rotary shaft of the second roller 63 functions as a space referring roller 63*a*. Further, the space referring roller 63*a* may be formed by forming the rotary shaft in a predetermined thickness.

Figure 2B:
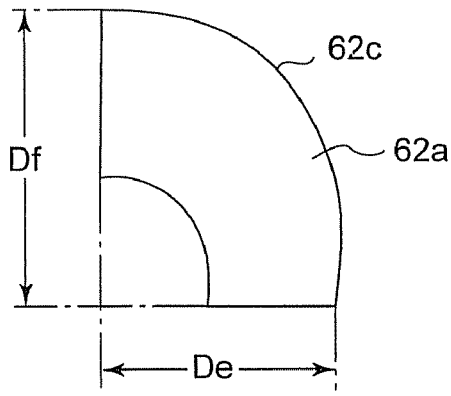
FIG. 2B is a front view showing the space setting cam used in the aligning roller pressurizing delay mechanism shown in FIG. 2.

The space setting cam 62*a* is given a predetermined pressure in the direction of an arrow D, for example, by an extension spring 64. By this pressure, the space setting cam 62*a* is rotated up to a position, balanced between the space setting cam 62*a* and the space reference roller 63*a* of the second roller 63, having a predetermined rotational angle. As shown in FIG. 2B, the space setting cam 62*a*, in the size from the rotational center thereof to the cam surface 62*c*, is given different outside diameters of a dimension Df on the side of an arrow F and a dimension De on the side of an arrow E. Namely, the dimension Df on the side of the arrow F is specified to be larger than the dimension De on the side of the arrow E. Separately from this, it is possible to give, for example, a predetermined weight for enabling a predetermined amount of rotation in the direction of the arrow D to the space setting cam 62*a*, thereby balance the rotational angle between the space setting cam 62*a* and the space reference roller 63*a* of the second roller 63. For example, the space setting cam 62*a* is weighted on the position thereof on the arrow E, thereby can be given a predetermined weight.

Further, the difference between the outside diameter on the side of the arrow E and the outside diameter on the side of the arrow F, in the copy machine 1, is specified on the basis of the thickness of a thickest sheet which may be used for image output. For example, the difference between the outside diameter De on the side of the arrow E of the space setting cam 62*a* and the outside diameter Df on the side of the arrow F, in the color copy machine 1, when the thickness of the thickest sheet which may be used for image forming is 250 μm, is specified to be at least 250 μm.

The space setting cam 62*a* is made of abrasion resistant resin such as polyacetal and the cam surface 62*c* thereof is always in contact with the space reference roller 63*a*. Further, the space reference roller 63*a* is a roller having a surface composed of resin or rubber given a friction coefficient in a fixed relationship to the friction coefficient of the surface of a sheet using the friction coefficient of a metal or the roller surface for image output.

Figure 3A:
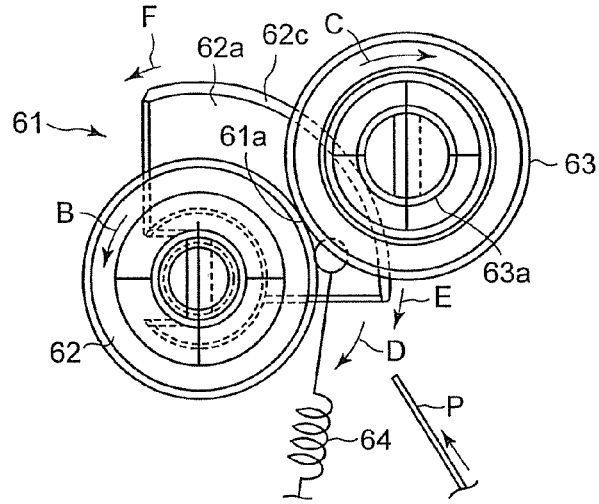
FIGS. 3A to 3C are schematic views for explaining the pressurizing delay mechanism of the aligning roller pair shown in FIG. 2.
Figure 3B:
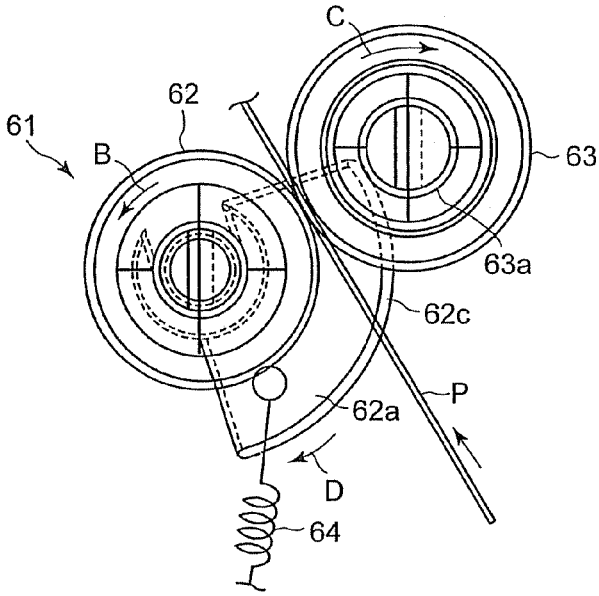
Figure 3C:
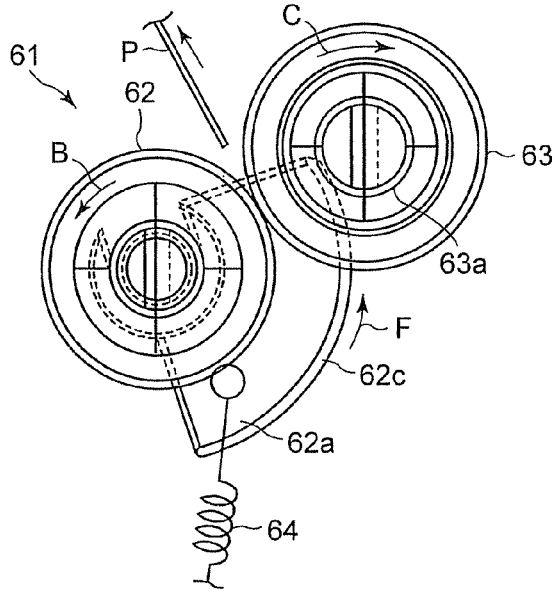

FIGS. 3A to 3C show the relationship between the space between the rollers of the aligning roller pair shown in FIG. 2 and the aligning roller pressurizing delay mechanism, that is, the rotational angle of the space setting cam.

The force in the opposite direction (the direction of the arrow C) to the can surface 62*c* of the space setting cam 62*a* given a predetermined pressure in the direction of the arrow D is given to the space reference roller 63*a*. Therefore, when there are no sheets P between the roller 62 of the aligning roller pair 61 and the roller 63 (the sheets P do not reach between the rollers of the aligning roller pair), as shown in FIG. 3A, the space setting can 62*a*, at the position at a predetermined rotational angle balanced with the rotation in the direction of the arrow C of the space reference roller 63*a*, is in the state against the rotation of the space reference roller 63*a*.

On the other hand, as shown in FIG. 3B, since there is a sheet P between the rollers 62 and 63 of the aligning roller pair 61 (the sheet P is guided between the rollers of the aligning roller pair), the roller 62 and roller 63 are separated at a space corresponding to the thickness of the sheet P. By this separation, the space setting cam 62*a*, at the position rotated at a predetermined angle related to the thickness of the sheet P, is moved into the state against the rotation of the space reference roller 63*a*. Namely, the space setting cam 62*a*, due to the thickness of the sheet P, in correspondence to the space between the roller 62 and the roller 63 in the state that the space to the roller 62 is spread, by sliding of the surface, is rotated up to the position balanced with the rotary power of the roller 63.

On the other hand, as shown in FIG. 3C, when the sheet P existing between the roller 62 and the roller 63 of the aligning roller pair 61 is completely separated from the rollers (the sheet P gets out of the rollers of the aligning roller pair), by the rotation of the space reference roller 63*a* rotating in the direction of the arrow C, the space setting cam 62*a* is pressed back in the direction of the arrow F.

At this time, to the space setting cam 62*a*, a predetermined force in the direction of the arrow D by the extension spring 64 is given. By the given predetermined force, the space setting cam 62*a*, after the sheet P is completely separated from the rollers, for a predetermined period of time specified on the basis of the difference between the rotary power of the roller 63 in the direction of the arrow C and the force by the spring 64 in the direction of the arrow D, due to the rolling contact between the surface of the space setting cam 62*a* and the surface of the space reference roller 63*a*, to the position where there is no sheet P as shown in FIG. 3A, is returned comparatively controllably. Therefore, the roller 62 of the aligning roller pair 61 and the roller 63 are not closely contacted to each other the moment the sheet P passes through the rollers but are closely contacted after a lapse of a fixed period time.

As mentioned above, on either of the rollers 62 and 63 of the aligning roller pair 61, the space setting cam is installed and on another, a stopper (a space reference unit with a large outside diameter) is installed, thus immediately after passing of the sheet P through the rollers, the space between the two rollers of the aligning roller pair is prevented from suddenly returning (the rollers of the aligning roller pair are closely contacted to each other).

By doing this, the sheet P to which the toner image is transferred at the image transfer position 6A is prevented from suddenly pressed out toward the fixing device 6 and the toner image transferred at the image transfer position 5A can be prevented from an occurrence of a displacement, that is, a transfer variation. Furthermore, a primary transfer variation and an exposure variation can be prevented.

Figure 5:
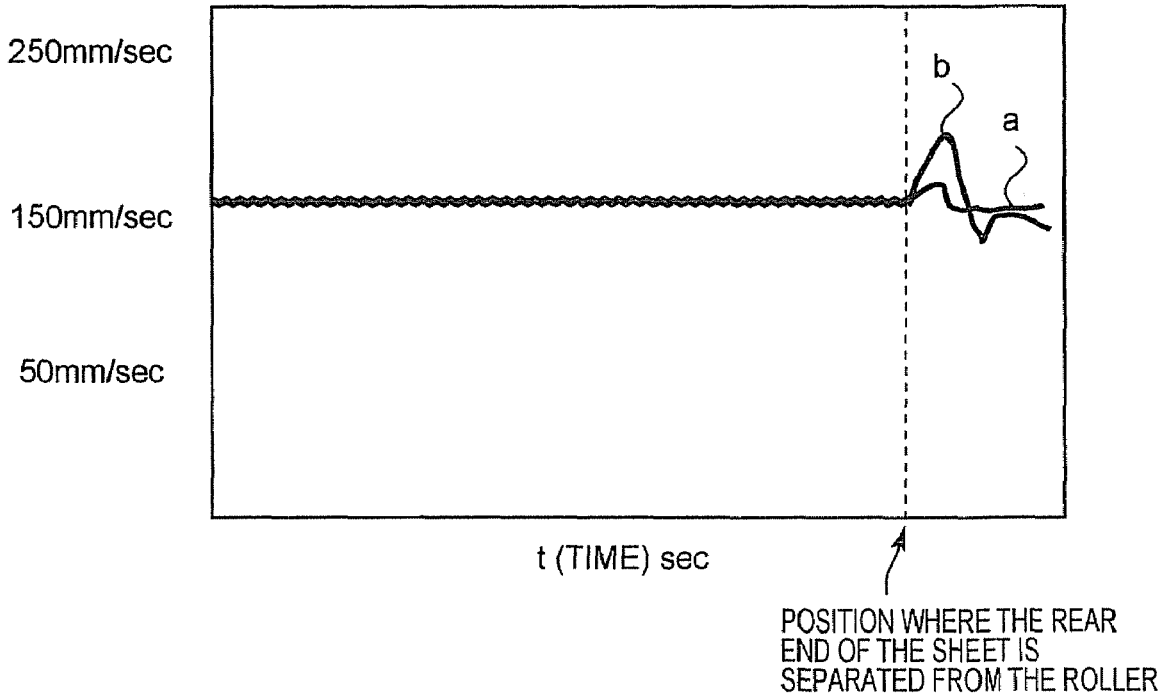
FIG. 5 is a graph for explaining an example of changes of the sheet conveying speed when the aligning roller pressurizing delay mechanism shown in FIG. 2 is used.

Further, as shown by a curve a in FIG. 5, by use of the aligning roller pair pressurizing delay mechanism (the cam 62*a* and reference roller 63*a*) explained in FIGS. 2 and 3A to 3C, compared with a curve b showing an example of a case that the pressurizing delay mechanism is not used, it is confirmed that the conveying speed of the sheet P is prevented from changing.

As explained above, the moment the rear end of the sheet conveyed toward the fixing device by transferring the toner image at the image transfer position gets out of the rollers of the aligning roller pair, the conveying speed of the sheet is prevented from increasing suddenly. By doing this, the toner image transferred can be prevented from an occurrence of a displacement, that is, a transfer variation. Furthermore, a primary transfer variation and an exposure variation can be prevented.

Further, in the pressurizing delay mechanism explained in FIGS. 2 and 3A to 3C, it is recommended just to give the rotational force (driving force) to at least either of the rollers of the aligning roller pair.

Next, another embodiment of the pressurizing delay mechanism of the aligning roller pair will be explained by referring to FIGS. 4A to 4C.

Figure 4A:
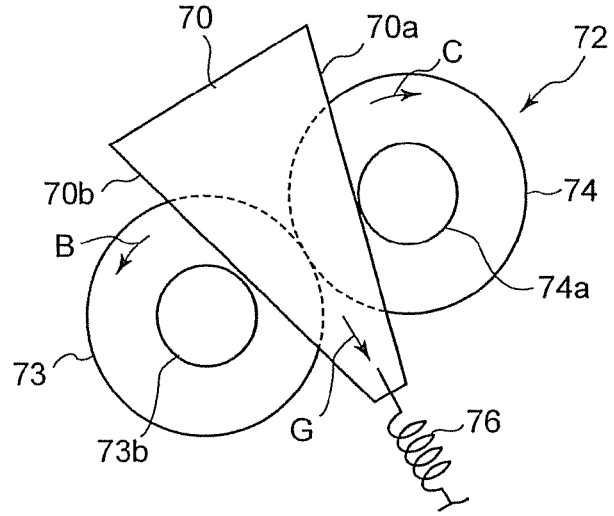
FIGS. 4A to 4C are schematic views for explaining another embodiment of the pressurizing delay mechanism of the aligning roller pair.

As shown in FIG. 4A, an aligning roller pair 72 are composed of a first roller 73 and a second roller 74 which are closely contacted to each other by a predetermined pressure. Further, in the example shown in FIG. 4A, the first roller 73 is rotated in the direction of an arrow B and the second roller 74 is rotated in the direction of an arrow C in the opposite direction of the arrow B. Therefore, the moving directions of the roller surfaces of the respective rollers are the same direction at a position 75A where both rollers make contact with each other.

Between a rotary shaft 73*b* of the first roller 73 and a rotary shaft 74*a* of the second roller 74, a space setting wedge 70 in a wedge shape is arranged. A right slant portion 70*a* of the space setting wedge 70 is in contact with the rotary shaft 74*a*. Similarly, a left slant portion 70*b* of the space setting wedge 70 is in contact with the rotary shaft 73*b*. To one end of the space setting wedge 70, an extension spring 76 is connected and the space setting wedge 70 is always extended in the direction of an arrow G. As a result, the right slant portion 70*a* of the space setting wedge 70 is pressurized to the rotary shaft 74*a* and the left slant portion 70*b* is pressurized to the rotary shaft 73*b*. In other words, the first roller 73 and second roller 74 are applied with force in the direction of mutual separation.

When there are no sheets P between the first roller 73 of the aligning roller pair 72 and the second roller 74 (the sheets P do not reach between the rollers of the aligning roller pair 72), as shown in FIG. 4A, the space setting wedge 70 stands still at the position where the rotary power of the rotary shaft 74*a* in the direction of the arrow C, the rotary power of the rotary shaft 73*b* in the direction of the arrow B, and the extension force of the extension spring 76 in the direction of the arrow F are balanced.

Figure 4B:
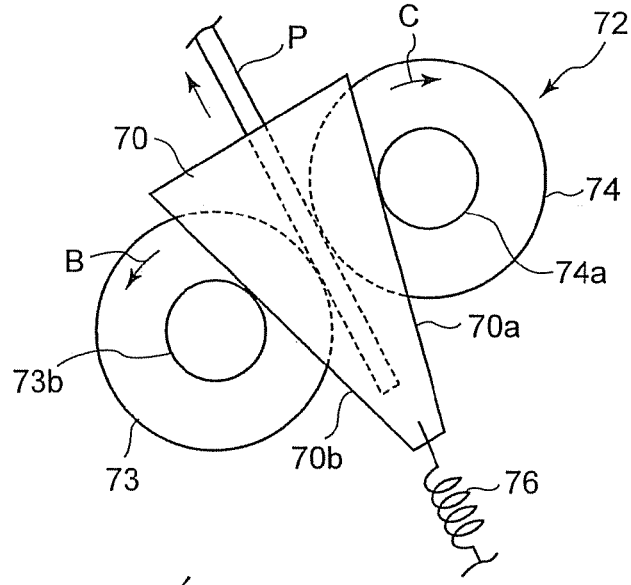

On the other hand, as shown in FIG. 4B, since there is a sheet P between the rollers 73 and 74 of the aligning roller pair 72 (the sheet P is guided between the rollers of the aligning roller pair 72), the roller 73 and roller 74 are separated at a distance corresponding to the thickness of the sheet P. By this separation, the space setting wedge 70 is moved at a predetermined distance related to the thickness of the sheet P in the direction of the arrow F. Namely, the space setting wedge 70, due to the thickness of the sheet P, in correspondence to the space between the roller 73 and the roller 74 in the state that the space between them is spread, is moved up to the position balanced with the rotary power of the roller 73 and roller 74.

Figure 4C:
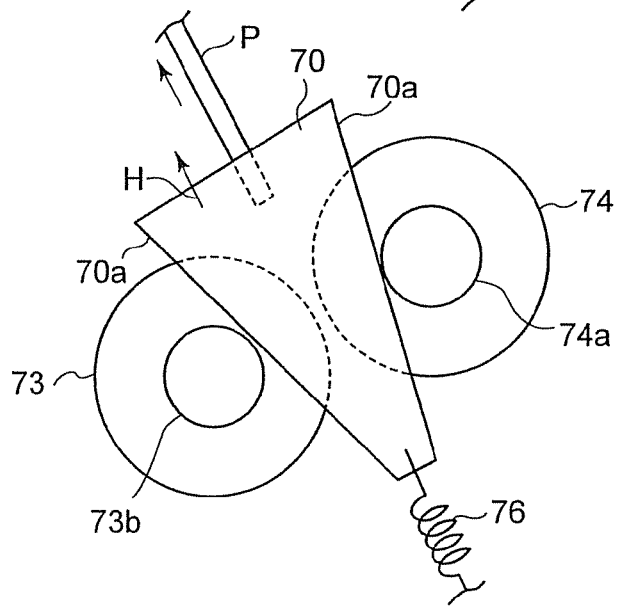

On the other hand, as shown in FIG. 4C, when the sheet P existing between the roller 73 of the aligning roller pair 72 and the roller 74 is completely separated from the rollers (the sheet P gets out of the rollers of the aligning roller pair 72), by the rotary force of the rotary shaft 74*a* in the direction of the arrow C and the rotary force of the rotary shaft 73*b* in the direction of the arrow B, the space setting wedge 70 is pressed back in the direction of the arrow H.

At this time, to the space setting wedge 70, a predetermined force in the direction of the arrow F by the extension spring 76 is given. By the given predetermined force, in the space setting wedge 70, after the sheet P is completely separated from the rollers, for a predetermined period of time specified on the basis of the difference of force between the force in the direction of the arrow D caused by the rotary power of the rotary shaft 74*a* in the direction of the arrow C and the rotary power of the rotary shaft 73*b* in the direction of the arrow B and a predetermined force by the extension spring 76 in the direction of the arrow G, as shown in FIG. 4A, the first roller 73 and second roller 74 are returned comparatively controllably to the position where there are no sheets P. Therefore, the roller 73 of the aligning roller pair 72 and the roller 74 are not closely contacted to each other the moment the sheet P passes through the rollers but are closely contacted after a lapse of a fixed period time.

As mentioned above, the space setting wedge is installed between the roller 73 of the aligning roller pair 72 and the roller 74, thus immediately after passing of the sheet P through the rollers, the space between the two rollers of the aligning roller pair is prevented from suddenly returning (the rollers of the aligning roller pair are closely contacted to each other).

By doing this, the sheet P to which the toner image is transferred at the image transfer position 5A is prevented from suddenly pressed out toward the fixing device 6 and the toner image transferred at the image transfer position 5A can be prevented from an occurrence of a displacement, that is, a transfer variation. Furthermore, a primary transfer variation and an exposure variation can be prevented.

Figure 6:
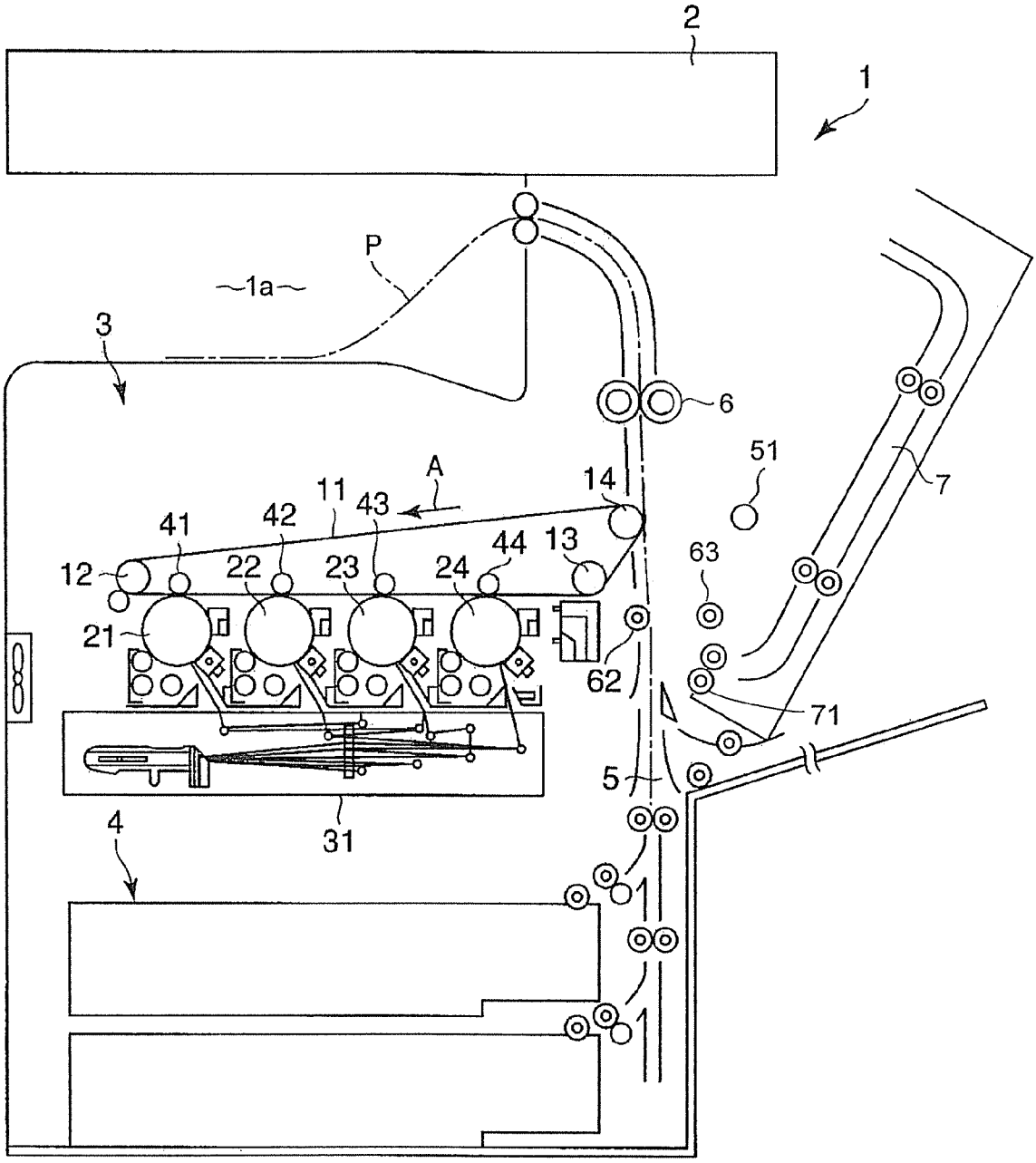
FIG. 6 is a schematic view showing the image forming apparatus in which a cover is opened.

As shown in FIG. 6, on a part of the main body 1, an openable and closable cover 1*b* is formed. In the cover 1*b*, the sheet reversing unit 7 is provided and furthermore, the transferring roller 51, the second roller 63 among the aligning roller pair 61 and the aligning roller pair 71 in the sheet reversing unit 7 are arranged. When the sheet P is jammed at the position of the aligning roller pair 61, the cover 1*b* is opened, thus the second roller 63 is separated from the first roller 62, so that the jammed sheet P can be removed. After removal of the sheet P, when the cover 1*b* is closed again, the aligning roller pair 61, that is, the first roller 62 and second roller 63 are rotated in a predetermined direction for a predetermined period of time. By this rotation, the space setting cam or space setting wedge is placed at a predetermined position.

The outside diameter of the space setting cam and the tension of the space reference roller and extension spring are set optionally on the basis of various parameters such as the number of image output sheets in the unit time, the diameters of the respective rollers of the aligning roller pair, and the pressure given between the rollers of the aligning roller pair.

The present invention is not limited to the embodiments aforementioned and within the scope of the present invention described in the claims, can be modified variously, and needless to say, those modifications are included in the scope of the present invention.

For example, in the embodiments, the aligning rollers are illustrated by examples. However, the sheet conveyor of the present invention can be applied to an aligning roller pair 71 in a sheet reversing unit 7 of the color copy machine 1, an automatic document feeder (ADF) integrally installed in the scanner unit 2, and a printer not drawn.

What is claimed is:

1. A sheet conveyor comprising:

a first roller;

a second roller pressurized to the first roller to hold and convey a sheet, wherein the first roller and the second roller are separated at a space equivalent to a thickness of the sheet when the sheet is held between the first roller and the second roller; and a pressurizing delay mechanism configured to bring controllably the first roller and the second roller into contact with each other after the sheet is conveyed from the first roller and the second roller.

2. The sheet conveyor according to claim 1, wherein the pressurizing delay mechanism includes:

a cam, provided slidably on a rotary shaft of the first roller, having a cam surface in contact with a space reference roller provided in the second roller so as to move the second roller in a direction of separating from the first roller; and a pressing member configured to give rotary force in a direction for rotating the cam.

3. The sheet conveyor according to claim 2, wherein in the cam, a distance from a rotational center to the cam surface is changed continuously on the basis of the thickness of the sheet.

4. The sheet conveyor according to claim 2, wherein after the sheet is conveyed from the first roller and second roller, the cam, due to rolling contact between the cam and a surface of the space reference roller in contact with the cam surface, is returned controllably to a position when the sheet does not exist between the first roller and the second roller.

5. The sheet conveyor according to claim 2, wherein the pressing member is an extension spring one end of which is connected to the cam.

6. The sheet conveyor according to claim 2, wherein the pressing member is a weight attached to the cam.

7. The sheet conveyor according to claim 2, wherein the cam, when a roller surface of the first roller and a roller surface of the second roller are in contact with each other, and the first and second rollers are rotated, thus the roller surfaces of the respective rollers are in contact with each other, stands still at a standby position at a predetermined rotational angle.

8. The sheet conveyor according to claim 1, wherein the pressurizing delay mechanism includes a space setting wedge in a wedge shape provided between the first roller and the second roller, wherein a first slant portion of the space setting wedge is in contact with a rotary shaft of the first roller and a second slant portion is in contact with a rotary shaft of the second roller.

9. The sheet conveyor according to claim 8, wherein the space setting wedge, when the first roller and the second roller are separated at the space equivalent to the thickness of the sheet, is extended by an extension spring so that the first and second slant portions move in a state kept in contact with the rotary shafts of the first and second rollers.

10. The sheet conveyor according to claim 9, wherein after the sheet is conveyed from the first roller and second roller, the space setting wedge, on the basis of a difference of force between rotary power of the rotary shaft of the first roller in contact with the first slant portion, rotary power of the rotary shaft of the second roller in contact with the second slant portion, and extension force by the extension spring, is returned controllably to a position when the sheet does not exist between the first roller and the second roller.

11. The sheet conveyor according to claim 1, wherein the second roller is mounted to a cover provided openably and closably and when the cover is closed after removal of a jammed sheet, the first and second rollers are rotated for a predetermined period of time.

12. An image forming apparatus comprising:

a transfer unit configured to transfer a toner image onto a sheet; and a sheet conveyor configured to send the sheet toward the transfer unit at predetermined timing, wherein the sheet conveyor includes:

a first roller;

a second roller pressurized to the first roller to hold and convey the sheet, wherein the first roller and the second roller are separated at a space equivalent to a thickness of the sheet when the sheet is held between the first roller and the second roller; and a pressurizing delay mechanism configured to bring controllably the first roller and second roller into contact with each other after the sheet is conveyed from the first roller and second roller.

13. A sheet conveying method comprising:

separating, when a sheet is held between a first roller and a second roller pressurized to the first roller to hold and convey the sheet, the first roller and the second roller at a space equivalent to a thickness of the sheet; and bringing controllably the first roller and second roller into contact with each other after the sheet is conveyed from the first roller and second roller.

14. The sheet conveying method according to claim 13, wherein the controllably bringing the first roller and second roller into contact with each other uses a cam, provided slidably on a rotary shaft of the first roller, having a cam surface in contact with a space reference roller provided in the second roller so as to move the second roller in a direction of separating from the first roller and the cam is given rotary power in a direction of rotation by a pressing member.

15. The sheet conveying method according to claim 14, wherein in the cam, a distance from a rotational center to the cam surface is changed continuously on the basis of the thickness of the sheet.

16. The sheet conveying method according to claim 15, wherein the cam makes contact with a predetermined position of the second roller at a predetermined pressure.

17. The sheet conveying method according to claim 14, wherein after the sheet is conveyed from the first roller and second roller, the cam, due to rolling contact between the cam and a surface of the space reference roller in contact with the cam surface, is returned controllably to a position when the sheet does not exist between the first roller and the second roller.

18. The sheet conveying method according to claim 14, wherein the pressing member is an extension spring one end of which is connected to the cam.

19. The sheet conveying method according to claim 14, wherein the pressing member is a weight attached to the cam.

20. The sheet conveying method according to claim 14, wherein the cam, when a roller surface of the first roller and a roller surface of the second roller are in contact with each other, and the first and second rollers are rotated, thus the roller surfaces of the respective rollers are in contact with each other, stands still at a standby position at a predetermined rotational angle.

* * * * *